United States Patent [19]

Slone

[11] 4,193,657

[45] Mar. 18, 1980

[54] ELECTRICAL CABLE TERMINATION

[76] Inventor: Ralph W. Slone, 12615 S. Groveside, La Mirada, Calif. 90638

[21] Appl. No.: 929,039

[22] Filed: Jul. 28, 1978

[51] Int. Cl.[2] ..... H01R 13/40; H01R 21/02

[52] U.S. Cl. ..... 339/63 M; 339/218 M

[58] Field of Search ..... 339/63 R, 63 M, 206 R, 339/206 P, 218 R, 218 M, 176 R, 176 M

[56] References Cited

U.S. PATENT DOCUMENTS 2,906,986 9/1959 Schaefer ..... 339/218 R

*Primary Examiner*—Neil Abrams

*Attorney, Agent, or Firm*—William C. Babcock

[57] ABSTRACT

A multiple projecting contact pot head termination that is formed on an end portion of an armored cable that maintains the electrical conductors in the termination in fixed insulated positions relative to one another, and with the assurance that they will not short out under adverse conditions such as when the termination is removably connected to an electric motor that actuates a down hole pump in an oil well. In forming the termination, a substantial length of the armor is separated from an end portion of the cable and internal insulation removed from the cable to expose the insulated conductors. Each conductor has the end portion of insulation removed therefrom, and the bared end portion subsequently soldered to a tubular externally threaded copper connector. Each connector threadedly engages an elongate copper terminal, and in association with first and second tubular sleeves is held in a fixed longitudinal position within a retainer of fiberglass or the like. The retainer and terminal defining end portions are placed within a metal housing and subsequently potted therein by use of an electrical insulating material such as neoprene or the like that is susceptible to being vulcanized or polymerized. After the potting operating armor is applied to the external surface of the potted portion and extends between the housing and free end portion of the armor not removed from the cable, with the newly applied armor being soldered to both the housing and the free end portion of the armor not removed from the cable.

3 Claims, 10 Drawing Figures

D
D-1
E
F
14
16
10
18
20
20a
20c
20b
H
40
32a
G
26
30
32
32c
22
32b
28

20
H
40
40
50
K
44
50
48
50

40
40
40

42
A
J
44
40
32
G
46
54
50
50
50
50
42
C
L

J
N
A
L
42
N
44

ELECTRICAL CABLE TERMINATION

BACKGROUND OF THE INVENTION

1. Field of the Invention

Electrical cable termination and method of forming same.

2. Description of the Prior Art

In oil field operations it is common practice to produce oil from wells by down hole pumps that are activated by electric motors adjacent the bottom of the well. Such motors are supplied with electric power by cables that extend downwardly in the wells from the ground surface, and the cables having terminations that are removably connected to the motors.

A primary object of the present invention is to provide a termination on the lower end of an armored cable in which the electrical conductors are held in fixed lateral and longitudinal spacing from one another, and one in which the electrical conductors will not short out when the termination is subject to vibration for prolonged periods of time in a hostile environment such as exists at the bottom of an oil well.

Another object of the invention is to supply a method of forming such a termination that is simple and easy to carry out and may be performed by relatively unskilled personnel after but a short period of training.

These and other objects and advantages of the invention will become apparent from the following description of the cable termination and method of forming the same.

SUMMARY OF THE INVENTION

In the forming of the armored cable termination an insulating retainer and flanged metal housing having a tubular portion are provided. Also, a copper connector, copper terminal, and insulating tubular sleeves are provided for each electrical conductor in the cable. In forming the termination, a substantial length of the armor is separated from an end portion of the cable, and internal insulation removed from the cable to expose substantial lengths of the insulated conductors. Each of the conductors so exposed has the end portion of insulation removed therefrom, and the bare end portion subsequently soldered to a tubular externally threaded copper connector. Each connector is extended through an insulating sleeve, which sleeve is then placed in one passage defined in a rigid retainer, which retainer is formed from fiberglass or like material. A copper terminal that has an internally tapped bore has a rearward portion thereof disposed in an insulating sleeve, which sleeve is mounted in axially alignment in a passage of the retainer, and cause to engage the threaded end of the connector. Each passage defines an intermediately disposed abutment against which the end of the insulating sleeve is situated as well as the abutment being engaged by a recess portion of the insulating sleeve that surrounds the copper connector. When each connector is in threaded engagement with the copper terminal, the sleeves are held in pressure contact with the abutment in the passage with which the connector and terminal are associated, and the connector and terminal are held in a fixed position in which they cannot move laterally or longitudinally relative to the retainer.

After all of the electric conductors in the cable have been secured to connectors, terminals, insulating sleeves as described above, and mounted in the retainer, the whole assembly is extended into a brass housing that has a flange and a tubular portion extending rearwardly therefrom. The retainer is placed within the tubular portion in such a location that the terminals extend forwardly therefrom. The cable after the end portions of the conductors therein have had the components above-described secured thereto, are together with the head disposed at least partially within a mold that may be heated and into which a polymerizable material is introduced to envelop the end portion of the armoured cable. The polymerizable material is then cured by heating the mold, and during this curing the terminals are held in fixed relationship in transverse passages formed in an end plate. After the cable termination has been formed as above-described, the armor that was removed from the end portion of the cable is replaced with new spiral-wound armor, which spiral-wound armor is secured to the tubular portion of the housing, as well as the end portion of the armor that was not removed from the cable.

DESCRIPTION OF THE PREFERRED EMBODIMENT

Figure 9:
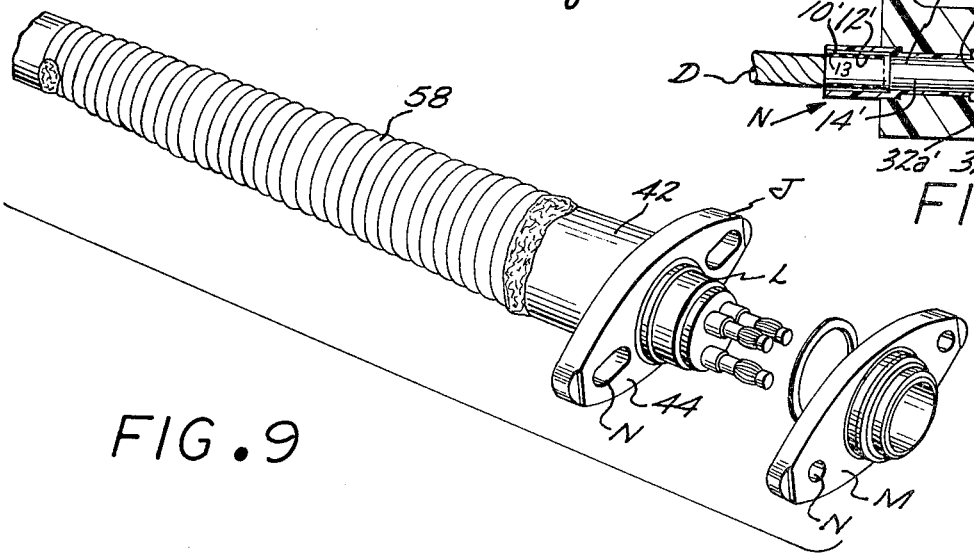
FIG. 9 is a perspective view of the finished termination and illustrating an adapter assembly that may be secured thereto to permit connection to one of the commercially available motors used in actuating a motor on a downhole pump.

The completed termination A as shown in FIG. 9 is formed on a free end portion of a multi-electrical conductor cable B, which cable has a spiral wound protective armor C on the exterior thereof. The cable B is illustrated as enveloping three laterally spaced second cables D, each of which second cables has electrical insulation E extending therearound. The extremity portions of the insulation E are removed from the second cables D to expose bared end sections D-1 of copper or other electrical conducting metals or alloys thereof as may be seen in FIG. 1.

An elongate copper connector F is provided for each conductor end section D-1. Each copper connector F includes a rearwardly disposed tubular portion 10 that has a forwardly extending elongate cavity 12 therein. An extension 14 of smaller diameter than rearward portion 10 extends forwardly from the latter. A forward section 16 of extension 14 has external threads 18 formed thereon. The bared end portion D-1 of each cable D is soldered within the confines of one of the cavities 12.

Each of the copper connectors F is provided with a tubular sleeve 20 formed from an electrical insulating material such as Teflon or the like. An elongate copper terminal G is provided for each connector F. Each copper terminal G includes a rearward tubular portion 22 that has internal threads 24 formed therein. An elongate extension 26 of smaller diameter projects forwardly from each of the tubular portions 22. A circumferentially extending recess 28 is formed in the free end portion of each extension 26, and each recess being removably engaged by a resilient "Multilam" contact 30 that is gold plated for maximum electrical conductivity and commercially available under that trademark. A second tubular sleeve 32 of insulating material is provided for each terminal G. Contact 30 engages an electrical conducting cavity (not shown) in a down hole pump (not shown) or other desired piece of electrical equipment.

A retainer H that is preferably formed from a rigid non-electrical conducting material such as fiberglass or the like is provided for each termination B. The retainer H has three sets of radially spaced, axially aligned rearwardly extending bores 34 and forwardly extending counterbores 36 that at their junctions define inwardly projecting abutments 38. Retainer H has a number of circumferentially spaced, longitudinal grooves 40 on the exterior thereof. When each connector F is threadedly connected to a copper terminal G within the retainer H with the first and second sleeves 20 and 32 mounted thereon, the forward portion of the first sleeve and rearward portion of the second sleeve are forced into pressure contact with the abutment 38 to prevent longitudinal movement of the connector and terminal relative to the retainer.

Each termination A includes a metal pot head J that is defined by a tube 42 that has a bolt receiving flange 44 on the forward end thereof. The tube 42 is of such internal diameter as to snugly receive the retainer H, with the terminals G projecting forwardly from the flange.

Figures 1, 2, 3, 4, 5:
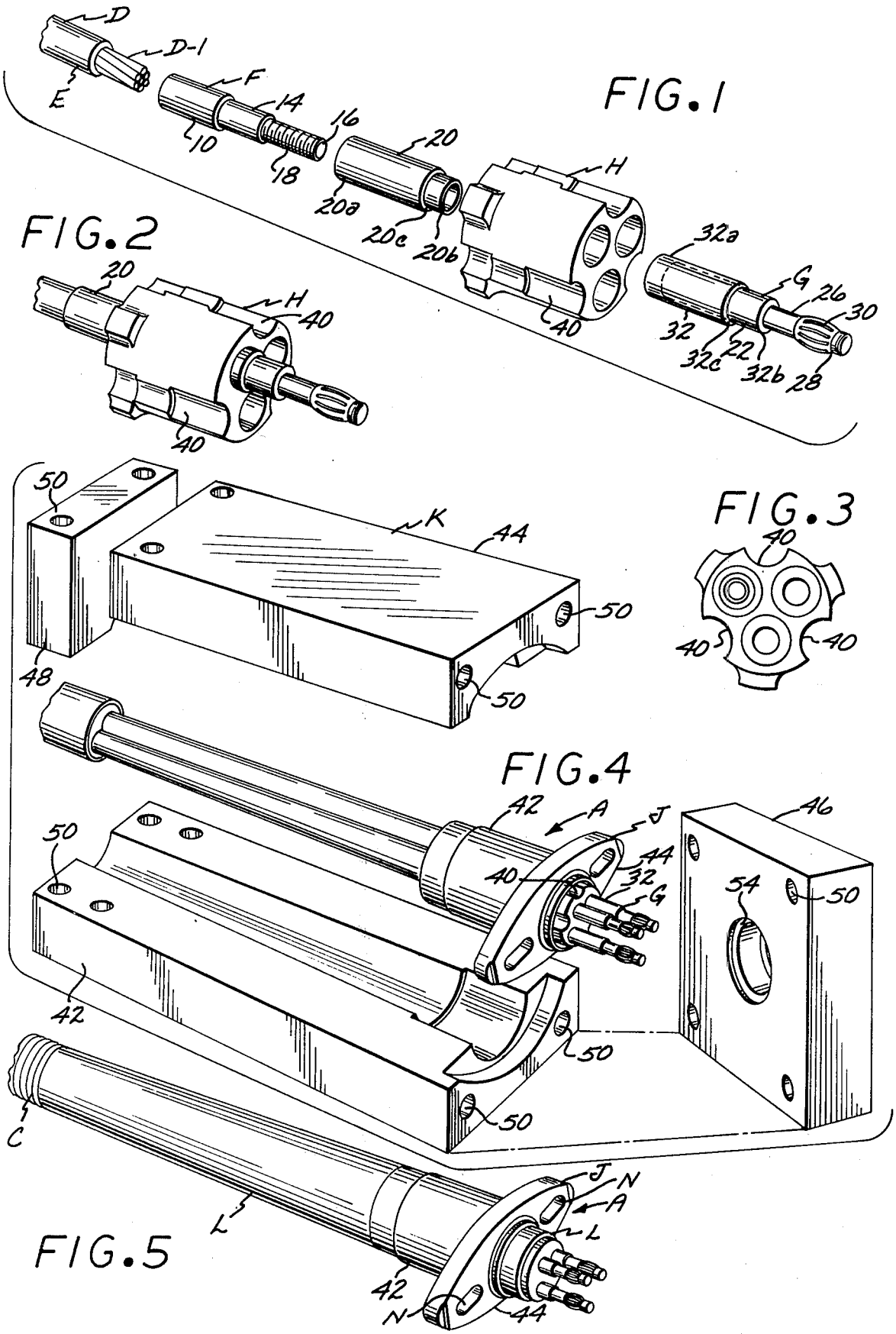
FIG. 1 is an exploded perspective view of the components utilized in providing one copper terminal assembly on an individual electrical conductor that forms a part of an armored electrical cable.
FIG. 2 is a perspective view of the components shown in FIG. 1 in the assembled position that they occupy when forming a part of the cable termination.
FIG. 3 is an end view of the retainer shown in FIG. 1.
FIG. 4 is an exploded perspective view of the mold and the cable termination, which mold is used in the potting operation.
FIG. 5 is a perspective view of the cable termination.

After the termination A has been assembled as shown in FIG. 4 it is disposed in a mold K that has a generally termination conforming lower platten 43, upper platten 45, forward end piece 46, and rearward end piece 48 that are provided with aligned bolt holes 50 through which bolts (not shown) may be extended to hold the mold together as an integral unit. The plattens are conventionally heated by electrical means (not shown). The mold K defines a cavity within the interior thereof into which a polymerizable or vulcanizable material L may be introduced under pressure by conventional means to define the elongate body portion of the termination. The material L prior to polymerizing or vulcanizing flows radially and longitudinally in the confined space defined within the mold K. The rearwardly disposed face 52 of end piece 46 has a recess 54 therein to form the forward extremity of the body of material L to the configuration shown in FIG. 9. The end piece 46 forwardly of recess 54 has radially spaced, parallel bores therein (not shown) that are slidably engaged by the forward portions of conductors G to maintain the conductors in desired spacing and alignment during the curing of the material L.

Figure 6:
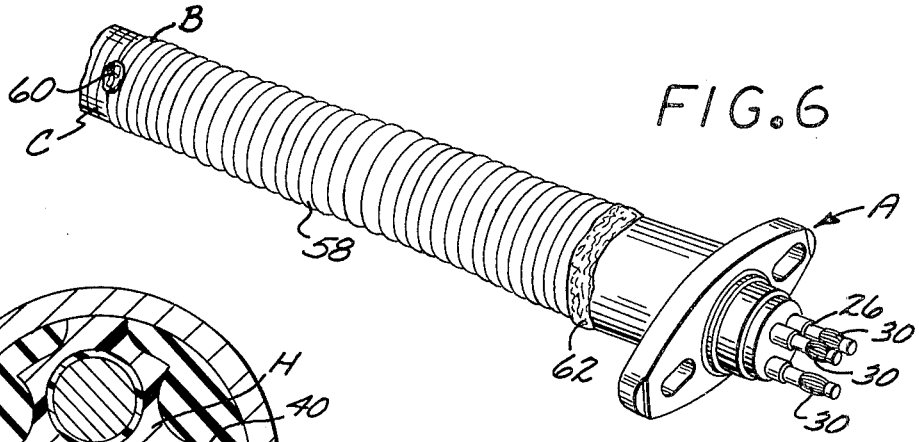
FIG. 6 is the same perspective view of the cable termination as shown in FIG. 5 but after the armor has been replaced on the end portion of the cable and secured by soddering or the like to the housing and the portion of the armor not removed from the cable.
Figure 8:
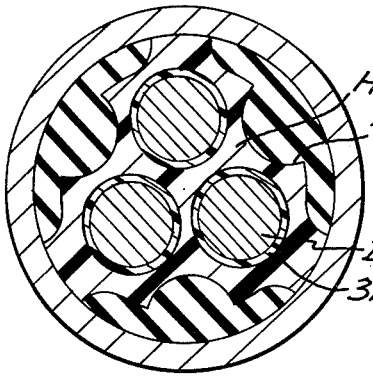
FIG. 8 is a transverse cross-sectional view of the cable termination taken on the line 8—8 of FIG. 7.

After the curing of the material L the latter is allowed to cool, and the termination A is then removed from the mold K by loosening the bolts (not shown). Spiral armor 58 is now wound helically around the exterior of the cured body of material L, with the rearward end of the spiral armor being secured to the forward extremity of armor C by soldering 60 and the forward end of the armor to the tube 42 by soldering 62 as shown in FIGS. 6 and 9.

In further detail it will be seen that each insulation sleeve 20 includes a rearward tubular portion **20*a* and forward tubular portion 20*b* that at their junction define a circumferential body shoulder 20*c*. The interior surfaces of the tubular portions 20*a* and 20*b* are of such diameter and length as to snugly engage the exterior surface of the rearward part of extension 14, all of the portion 10 as may be seen in FIG. 7 and extend rearwardly over the insulation E. The body shoulder 20*c* is in abutting contact with a body shoulder 13 formed at the junction of tubular portion 10 and extension 14**.

Each insulating sleeve 32 includes a rearward tubular portion **32*a* and forward tubular portion 32*b* that at their junction define a circumferential body shoulder 32*c*. The tubular portions 32*a* and 32*b* are of such diameter and length as to snugly engage all of terminal portion 22 and a rearward part of extension 26, with the body shoulder 32*b* abutting against a body shoulder 33 formed at the junction of portion 22 and extension 26 of terminal G as shown in FIG. 7**.

Figure 7:
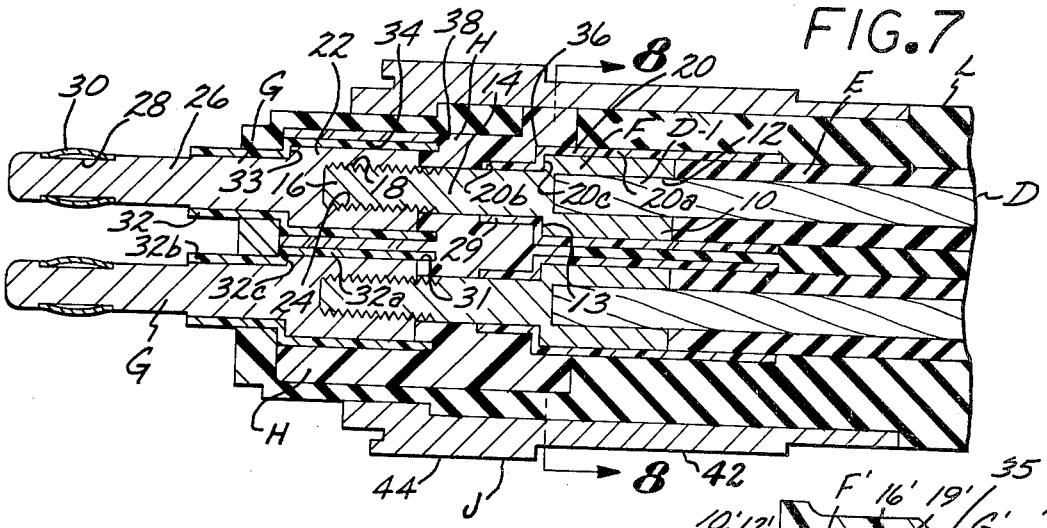
FIG. 7 is a longitudinal cross-sectional view of the cable termination.

The forward tubular portion **20*b* of each sleeve 20 is snugly received in a recess 29 formed in retainer H as shown in FIG. 7. The rearward part of each sleeve portion 32*a* is snugly received in a recess 31 formed in retainer H as shown in FIG. 7. The grooves 40 formed in retainer H allow forward flow of the polymerizable material L in the mold K to form the portion L-1 that projects forwardly from flange 44** prior to the material L being cured.

In FIG. 9 an adapter plate assembly M is shown that may be removably secured to flange 44 by bolts (not shown) that engage aligned bore holes N, and the adapter assembly permitting the termination A to engage a particular multi-socketed electrical connection on a desired commercially available motor on a down hole pump.

Figure 10:
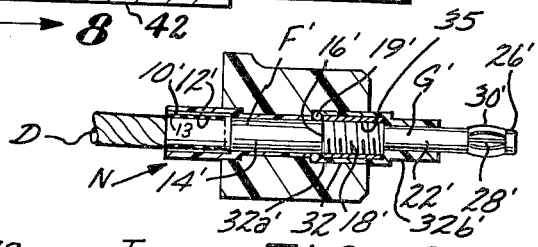
FIG. 10 is a side elevational view of an alternate form of connector and terminal and the second tubular sleeve used therewith.

Should it be desired an alternate form of connector F' and terminal G' may be employed as shown in FIG. 10 that are formed as an integral unit and are used in conjunction with a second tubular sleeve 32'. An O-ring 19 mounted on the terminal G' sealingly engages the body shoulder 33' when the second tubular sleeve 32' that has internal threads 35 is in threaded engagement with the threads 18'. The alternate form of connector F' and terminal G' and second tubular sleeve 32' serve the same function as the connector F, terminal G and second tubular sleeve previously described.

The structure of the termination A and method of making the same has been described previously in detail and need not be repeated.

What is claimed is:

1. In combination with a multi-conductor metallic armored electric cable that has had the metallic armor removed from an end portion thereof to expose a plurality of spaced electrical conductors that are enveloped in separate electrical insulating covers that have end portions thereof removed to expose sections of the bare conductors, a termination for said armored electric cable, said termination including:

a. a plurality of metallic connectors, each of said connectors including a first tubular rearward portion, an elongate first extension projecting forwardly from said rearward portion, said first rearward portion and first extension defining a first body shoulder at their junction, said first extension having external threads on a forward section thereof, and each of said connectors having one of said bare sections of one of said conductors inserted within said first rearward tubular portion and metalically bonded thereto;

b. a plurality of metallic terminals, each of said terminals including an internally threaded second rearward portion, a second elongate extension projecting forwardly from said second portion and defining a second circular body shoulder at the junction therewith;

c. a plurality of first electrical insulating tubular sleeves that are removably mounted on said connectors to envelop a part of said first extensions, all of said first rearward portions, and said first tubular sleeves extending rearwardly over said insulating covers rearwardly of said bared end sections;

d. a plurality of second electrical insulating tubular sleeves that are removably mounted on said terminals to envelop a rearward part of said second extensions and all of said second rearward portions;

e. a retainer formed from an electrical insulating material that has a plurality of circumferentially spaced, parallel sets of axially aligned bores and counterbores therein that at their junctions define inwardly extending abutments, with each of said sets having one of said connectors and terminals and associated first and second sleeves partially disposed therein and held in a fixed longitudinal position in said retainer by said external threads on said first extension threadedly engaging said internal threads in said second tubular end to hold said first and second sleeves in pressure contact with said retainer;

f. a metallic pot head that includes a tube that has a transverse flange secured to a forward end thereof, said tube having said retainer disposed therein with said second extensions of said terminals projecting forwardly from said flange;

g. a generally cylindrical body of polymerized electrical insulating material that fills said tube and envelops said retainer and first and second sleeves and extends rearwardly to the forward edge of said metallic armor not removed from multi-conductor cable; and h. replaced metallic armor that envelops said body of electrical insulating material rearwardly of said tube, with said forward end of said replaced metallic armor bonded to a rearward portion of said tube and a rearward portion of said replaced metallic armor bonded to the forward portion of said metallic armor not removed from said multi-conductor metallic armored cable.

2. A termination as defined in claim 1 in which a circumferentially extending recess is formed, and said termination further including:

i. a resilient contact mounted in said recess.

3. A termination as defined in claim 2 in which said contact is plated with a non-corroding metal for maximum electrical conductivity between it and an electrical conducting cavity of a piece of electrical equipment.

* * * * *